United States Patent [19]

Utsumi et al.

[11] 4,318,718

[45] Mar. 9, 1982

[54] DISCHARGE WIRE CLEANING DEVICE FOR AN ELECTRIC DUST COLLECTOR

[75] Inventors: Masatoki Utsumi; Nobuo Ohi, both of Toyota; Yasuhiro Kishiue, Nagareyama; Kazumi Nose, Matsudo, all of Japan

[73] Assignee: Ichikawa Woolen Textile Co., Ltd., Tokyo, Japan

[21] Appl. No.: 168,125

[22] Filed: Jul. 14, 1980

[30] Foreign Application Priority Data

Jul. 19, 1979 [JP] Japan ..... 54-98830[U]

[51] Int. Cl.[3] ..... B03C 3/00

[52] U.S. Cl. ..... 55/121; 55/13; 55/151

[58] Field of Search ..... 55/12, 13, 114, 112, 55/121, 296, 298, 297, 151; 15/104.04, 256.5, 256.6; 165/95

[56] References Cited

U.S. PATENT DOCUMENTS 3,929,436 12/1975 Kim et al. ..... 55/121

FOREIGN PATENT DOCUMENTS 697359 9/1953 United Kingdom ..... 55/112

*Primary Examiner*—Bernard Nozick

*Attorney, Agent, or Firm*—Edward A. Sokolski

[57] ABSTRACT

A discharge wire cleaning device for an electric dust collector in which when the dust accumulates to a certain extent on the discharge wires which are arranged vertically with each end secured to the frame, the compressed gas is ejected from the gas nozzle at the base of the discharge wires to apply pressure to the skirt and drive it upwardly thereby removing the dust on the discharge wires, after which the sliders are allowed to move down by gravity to their lowest portion. A damper may be provided on the upper portion of each discharge wire so that the slider is urged downwardly against the friction of the dust still remaining on the wire and can be moved up and down repeatedly. A brush may be provided on the slider so that the dust is effectively scraped off the discharge wires.

8 Claims, 6 Drawing Figures

DISCHARGE WIRE CLEANING DEVICE FOR AN ELECTRIC DUST COLLECTOR

FIELD OF THE INVENTION

This invention relates to a technology for automatically removing dust from discharge wires of a discharge pole type electric dust collector without disassembling the discharge wires.

BACKGROUND OF THE INVENTION

Electric dust collectors have found wide use in various fields of industry in view of the fact that an electric dust collector can dispose of a large amount of dust-laden gases with a relatively small pressure loss and can remove very small dust particles (of the order of micron size).

In conventional electric dust collectors, it is relatively easy to clean the dust collecting electrode plates by blowing gases and cleaning liquids against them. However, it has been difficult to remove dust from thread-like discharge wires. The hammering technique widely used on electrode plates in which mechanical vibration is applied to such plates cannot be employed for the discharge wires. As the dust accumulates on the wires, the discharging function of the discharge wires deteriorates.

In order to cope with these problems, the following measures have been adopted in conventional dust collectors. As shown in FIG. 1, a bead-like slider 9o is slidably fitted over each of the discharge wires 4 which are vertically stretched with their ends secured to frame 2'. Periodically, each discharge wire unit is disassembled from its frame and is manually turned upside-down to cause the sliders to fall along the discharge wires by gravity, thereby removing the dust.

However, because dozens of discharge wires 4 are secured to the frame 2', the need to remove each such unit for cleaning places substantial limitations on the design of dust collecting electrode plates and like mechanisms. Furthermore, it requires skill to reinstall the discharge wire unit in place with accuracy. This conventional dust collector also has the disadvantage in that repair of the units is often required after the cleaning is carried out due to inadvertent damage thereof.

SUMMARY OF THE INVENTION

The primary object of this invention is to solve the aforementioned problems of removing dust from the discharge wires in conventional dust collectors.

The second object of this invention is to provide a discharge wire cleaning device for an electric dust collector in which a slider is slidably fitted over each of the vertically stretched discharge wires so that dust adhering to the wires can automatically be removed by moving the sliders up or down by the use of gas pressure without disassembling the discharge wire unit.

This invention relates to a discharge wire cleaning device for an electric dust collector and more particularly to a discharge wire cleaning device in which a slider with a downwardly enlarged skirt is slidably fitted over each of the vertically stretched discharge wires and is moved up or down by injecting compressed gases against the sliders to clean the discharge wires.

DESCRIPTION OF THE PREFERRED EMBODIMENT

Figure 1:
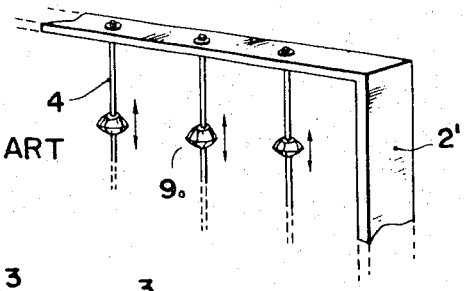
Fig. 1 PRIOR ART
FIG. 1 is a perspective view of a portion of the conventional prior art discharge wire unit.
Figure 2:
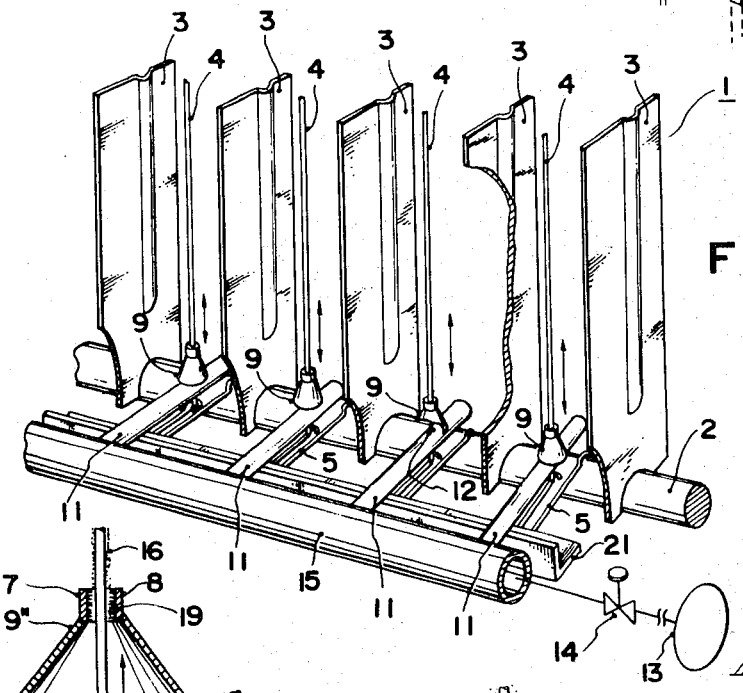
FIG. 2 is a partially cutaway view of a preferred embodiment of the invention.
Figure 3:
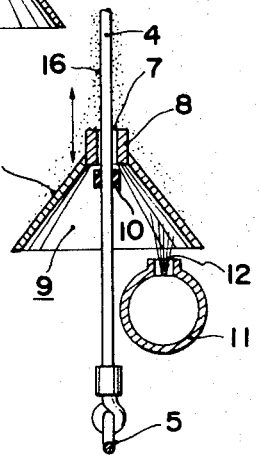
FIG. 3 is an enlarged cross-sectional view of the wire cleaner of FIG. 2.

Referring to FIGS. 2 and 3, except for the wire cleaner of the present invention, reference numeral 1 denotes the internal mechanism of an electric dust collector of known construction. A plurality of dust collecting electrode plates 3 are mounted vertically on the frame 2 with equal intervals therebetween. Between the dust collecting electrode plates 3, discharge wires 4 are disposed vertically at equal intervals with their upper and lower ends supported by hook brackets 5 (upper brackets not shown) which are fitted to the frame 2. Each discharge wire 4 has a slider 9 fitted over it so that the slider 9 can slide up and down the wire 4. As shown in FIG. 3, the slider 9 consists of a collar 8 with a hole 7 through which the wire 4 is inserted, and of a downwardly enlarged skirt 6 rigidly fixed to the base of the collar 8. Stopper 10 is made of an elastic material, such as rubber, and is fixedly attached to a lower portion of the discharge wire 4.

A gas ejector pipe 11 is located below the stopper 10 of each wire and has an ejector nozzle 12 below the slider 9 of each discharge wire 4. The gas ejector pipes 11 traverse the frame 2 and have a nozzle 12 which is directed upwardly so that the gas is ejected into the skirt 6 of the slider 9. The base of the gas ejector pipe 11 is connected to a gas supply pipe 15 which in turn is connected to a compressed air source 13 through a valve 14.

Except for the sliders 9, all the components that constitute the internal mechanism of the electric dust collector are rigidly secured to each other. Numeral 16 designates dust in the air that settled on the discharge wire 4 during the operation of the dust collector.

In the operation of the dust collector of the above construction, the valve 14 is kept closed such that the sliders 9 rest on the stoppers 10 attached to the wires 4 while the discharge wires 4 are made to discharge current to collect dust contained in the gas passing through the wires.

During such operation, the dust 16 adheres to the discharge wires 4. This reduces the discharge efficiency.

The timing for the removal of such dust is predetermined by the data which has been obtained by experiments or may be determined by visual inspection through an observation glass (not shown) on the casing. When the time for removing dust arrives, the fan for delivering dust-laden air through the discharge wires is turned off and at the same time valve 14 is opened to supply compressed air from the gas source, i.e., the compressed air source 13 in the present embodiment. The compressed air supplied through the gas supply pipe 15 is fed to the gas ejector pipes 11 from which it is ejected upward through nozzles 12. The air ejected from each nozzle 12 applies pressure against the inner surface of the skirt 6 of the slider 9, some of the air moving up past the hole 7 of the collar 8 along the wire 4.

The sliders 9 are moved up, by the pressure of the air, along the discharge wire, scraping the dust off the wire. The dust thus removed falls down the external surface of the skirt 6. The air jet blowing upwardly through the hole 7 of the collar 8 helps to effectively remove the dust.

When the valve 14 is closed the slider 9 is allowed to drop by gravity. The valve 14 may be made to open and close intermittently and repeatedly at a certain interval to move the slider up and down at a desired rate.

Figure 6:
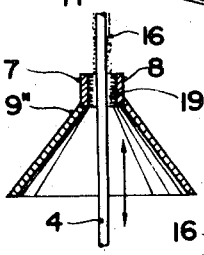
FIG. 6 is a cross-sectional view of still another embodiment of the wire cleaner of the invention showing a brush provided for the inner surface of the collar of the slider.
Figure 4:
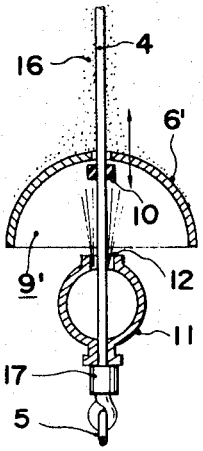
FIG. 4 is a cross-sectional view of a second embodiment of the wire cleaner of the invention.
Figure 5:
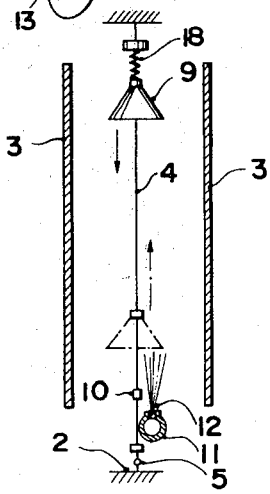
FIG. 5 is a view showing the action of a damper which may be employed in implementing the invention.

The slider may be constructed so that the skirt 6' is of a hollow hemispherical shape, as shown in FIG. 4. The material of the slider may be given greater stiffness so that it can withstand the shock produced at the upper and lower ends of the travel. In this case the collar 8 may be omitted. As shown in FIG. 4, the discharge wire 4 may be made to run through the gas ejector pipe 11 at its center at right angles thereto, passing coaxially through the nozzle 12, with a seat 17 interposed between the hook bracket 5 and the ejector pipe 11. Furthermore, where the pressure of the air jet is increased to more effectively remove the dust from the wire, a damper 18 such as a cushion spring may be provided to the wire near the upper end of the travel of the slider 9 (9') to absorb the shock, as shown in FIG. 5. This damper 18 also provides spring action to help the slider move down the wire smoothly when dust still remains on the wire and therefore may hinder the slider from easily falling by gravity.

Where the particles of dust 16 are infinitesimally small and the adhesion of these particles to the discharge wires is likely to substantially deteriorate the discharging efficiency, a nylon bristle brush 19 may be provided to the inner surface of the hole 7 of the collar 8, as shown in FIG. 6.

It should be noted that the present invention is not limited to the above-mentioned examples and that various modifications may be made to them. For example, the slider may be replaced by a rotary blade type slider. Furthermore, the skirt 6 (6'), collar and brush may be constructed of bakelite or other insulating material such as resin.

The dust collector may be of the Cottrell type or two-stage type, or may be of other type.

There are various techniques available for controlling the supply of compressed air. The compressed air supply may be controlled by a timer, or may be synchronized with the supply of the dust-laden gas, or may be controlled by detecting a decrease in the discharge current.

As can be seen from the foregoing description, the dust collector of this invention has a construction such that the sliders with the skirt are fitted over the vertically stretched discharge wires secured to the frame, and that the dust removing sliders are moved up and down the wires by ejecting compressed air from the nozzle into the skirt. Because of this construction, the dust collector of this invention has the advantage that the dust adhering to the dischage wires can automatically be removed without vibrating the wires with hammering or without disassembling the wires but by simply moving the slider up and down by means of the gas pressure.

Since the dust removing process is quite simple, it will not interfere with or adversely affect other mechanisms involved.

Furthermore, the gas that discharges upwardly through the collar of the slider removes the dust from the wire in advance of the slider.

By constructing the brush with an insulating material to insulate the skirt from the wire, it is also possible to perform scraping action while the dust collector is in operation, thereby maintaining the utilization of the device at high level.

The fact that the slider is moved up by the pressure of gas rather than the mechanical force has the advantages that the chances of mechanical breakdown are minimized, the power required is small, and efficiency of operation is maintained at a high level.

Because the dust can be removed without disassembling the discharge wires, not only can the present invention be applied to a large-size dust collector, but also the dust scraping operation can be performed at any desired time. This improves the discharge efficiency and therefore the dust collecting efficiency.

We claim:

1. An electric dust collector having a frame and at least one discharge wire supported on said frame, comprising a discharge wire cleaning device for cleaning said discharge wire, a slider having a downwardly enlarged skirt, said slider being slidably fitted over the discharge wire for movement up and down the wire, a gas ejector nozzle directed upwardly towards the skirt, and means for intermittently supplying pressurized gas to said nozzle, said gas being intermittently fed to said nozzle and ejected therefrom against said skirt so as to drive said slider along the wire in a first direction, said slider moving by gravity in a second direction opposite to said first direction when the supply of gas is interrupted, thereby removing the dust from the wire.

2. A discharge wire cleaning device for an electric dust collector as set forth in claim 1, wherein said slider has a brush provided at the upper portion thereof for removing dust from the discharge wires.

3. A discharge wire cleaning device for an electric dust collector as set forth in claim 1 and including a plurality of said nozzles and said wires with one of said sliders for each of said wires and wherein one of said gas ejector nozzles is located adjacent to each of the discharge wires.

4. A discharge wire cleaning device for an electric dust collector as set forth in claim 1, wherein said gas ejector nozzle is disposed coaxial with the discharge wire which passes through it.

5. A discharge wire cleaning device for an electric dust collector as set forth in any one of claims 1 through 4, wherein said skirt of the slider is of conical shape.

6. A discharge wire cleaning device for an electric dust collector as set forth in any one of claims 1 through 4, wherein said skirt of the slider is of hemispherical shape.

7. An electric dust collector having a frame and a plurality of discharge wires supported on said frame, comprising a discharge wire cleaning device for cleaning dust from said discharge wires, sliders having downwardly enlarged skirts, one of said sliders being slidably fitted over each of the discharge wires for movement up and down the wire, a damper for each said slider mounted on the upper portion of each discharge wire, gas ejecting nozzles directed upwardly towards each of the skirts, and means for intermittently supplying pressurized gas to said nozzles for ejection therefrom against said skirts so as to drive said sliders along the wires in a first direction until they strike said dampers whereupon the supply of gas is interrupted and the sliders are driven by gravity in a second direction opposite to said first direction, thereby removing the dust therefrom.

8. A discharge wire cleaning device for an electric dust collector as set forth in claim 7 wherein said dampers comprise spring means for urging said sliders downwardly when the sliders strike thereagainst.

* * * * *